US006220897B1

(12) United States Patent
Maxwell

(10) Patent No.: US 6,220,897 B1
(45) Date of Patent: Apr. 24, 2001

(54) ELECTRICAL OUTLET ASSEMBLY

(76) Inventor: Albert David Maxwell, 2199 Wiseman Ct., Mississauga, Ontario (CA), L6J 1P3

( * ) Notice: Subject to any disclaimer, the term of this patent is extended or adjusted under 35 U.S.C. 154(b) by 0 days.

(21) Appl. No.: 09/488,073

(22) Filed: Jan. 20, 2000

(51) Int. Cl.[7] ..... H01R 25/00
(52) U.S. Cl. ..... 439/652; 439/535
(58) Field of Search ..... 439/535, 650, 439/652, 653

(56) References Cited

U.S. PATENT DOCUMENTS

| | | | | |
|---|---|---|---|---|
| 1,568,156 | * | 1/1926 | Herskovitz . | |
| 2,433,917 | * | 1/1948 | McCartney . | |
| 3,609,647 | * | 9/1971 | Castellano | 339/122 |
| 4,245,880 | * | 1/1981 | Zimmerman, Jr. et al. | 339/97 |
| 4,504,103 | * | 3/1985 | Woedl | 339/34 |
| 4,705,342 | * | 11/1987 | Schwartz | 439/650 |
| 4,717,350 | * | 1/1988 | Lax | 439/92 |
| 4,778,399 | * | 10/1988 | Schenk | 439/147 |
| 4,930,047 | * | 5/1990 | Peterson | 361/395 |
| 5,257,946 | * | 11/1993 | MacMillan et al. | 439/536 |
| 5,844,763 | * | 12/1998 | Grace et al. | 361/111 |

* cited by examiner

*Primary Examiner*—Lincoln Donovan
*Assistant Examiner*—Thanh-Tam Le
(74) *Attorney, Agent, or Firm*—Ridout & Maybee; Dolly Kao

(57) ABSTRACT

An electrical outlet assembly installable in a wall of a building for use in connecting an electrical appliance to a source of electrical power. The electrical outlet assembly includes an electrical outlet and a housing for releasably receiving the electrical outlet. The electrical outlet has at least one outlet socket for receiving an electrical connector of the appliance, an outlet connector, and means for electrically connecting the outlet socket to the outlet connector. The housing has a power terminal, the power terminal having a housing socket for releasably receiving the outlet connector, and means for electrically connecting the housing socket to a power source. The housing also has an opening sized to receive the electrical outlet therethrough and for communicating with an exterior of the wall when the housing is mounted inset in the wall. When the housing is mounted inset in the wall and the housing socket is connected to the power source, the electrical outlet may be releasably received in the housing by inserting the electrical outlet through the opening and releasably inserting the outlet connector in the housing socket. An electrical appliance may then be connected to the power source by inserting an electrical connector of the appliance in a socket of the electrical outlet.

4 Claims, 4 Drawing Sheets

ELECTRICAL OUTLET ASSEMBLY

FIELD OF THE INVENTION

The present invention relates to an electrical outlet assembly for use in connecting an electrical appliance to a source of electrical power.

BACKGROUND TO THE INVENTION

Electrical outlets are common in residential and commercial establishments, and elsewhere, for connecting various electrical appliances to a source of electrical power. Commonly, electrical power is supplied to building through a central panel in which there are replaceable fuses or resettable breakers for each electrical circuit in the building. Each electrical circuit has one or more electrical outlets placed strategically in various rooms in the building. Most commonly, the electrical outlets are inset into walls. The outlets have a pair of sockets into which plugs of electrical appliances may be inserted. These electrical outlets are housed in metal boxes placed in the walls during construction where electrical power is needed.

As electrical appliances have become used more extensively, it has become common practice to use a device comprising a plurality of sockets connected electrically to a plug which is insertable into a wall socket. In this way, a plurality of appliances may be connected to a single wall socket. A special type of this device is a power spike and line noise protector which is useful for plugging in sensitive electronic equipment, such as computers. An example of a commercially available power spike and line noise protector is sold under the trade-mark, Power Bar. Power Bars typically have three to six sockets connected electrically to a plug at the end of an extension cord. Problems with Power Bars are that they can be tripping hazards and unsightly. A problem with conventional wall mounted electrical outlets is that, when there is a power overload and a breaker needs to be reset or a fuse needs to be replaced, one must go to the fuse box which is often inconveniently located in the basement or garage of a home. Also, many people are unfamiliar with the operation of central switch boxes and are hesitant or reluctant to attempt to reset a tripped breaker or to replace a burnt-out fuse. The present invention seeks to provide a solution to the aforementioned problems.

SUMMARY OF THE INVENTION

The present invention provides an electrical outlet assembly installable in a wall of a building for use in connecting an electrical appliance to a source of electrical power. The electrical outlet assembly includes an electrical outlet and a housing for releasably receiving the electrical outlet. The electrical outlet has at least one outlet socket for receiving an electrical connector of the appliance, an outlet connector, and means for electrically connecting the outlet socket to the outlet connector. The housing has a power terminal, the power terminal having a housing socket for releasably receiving the outlet connector, and means for electrically connecting the housing socket to a power source. The housing also has an opening sized to receive the electrical outlet therethrough and for communicating with an exterior of the wall when the housing is mounted inset in the wall. When the housing is mounted inset in the wall and the housing socket is connected to the power source, the electrical outlet may be releasably received in the housing by inserting the electrical outlet through the opening and releasably inserting the outlet connector in the housing socket. An electrical appliance may then be connected to the power source by inserting an electrical connector of the appliance in a socket of the electrical outlet.

BRIEF DESCRIPTION OF THE DRAWINGS

Preferred embodiments of the invention will now be described with reference to the drawings in which.

Throughout the specification, directional indicators such as "top" and "bottom" are used in reference to the drawings and for convenience only. Furthermore, in this specification, the terms "comprising" and "comprises" are taken to specify the presence of the stated features, integers, steps or components but do not preclude the presence or addition of one or more other features, integers, steps, components or groups thereof.

DETAILED DESCRIPTION OF PREFERRED EMBODIMENTS

Figure 1:
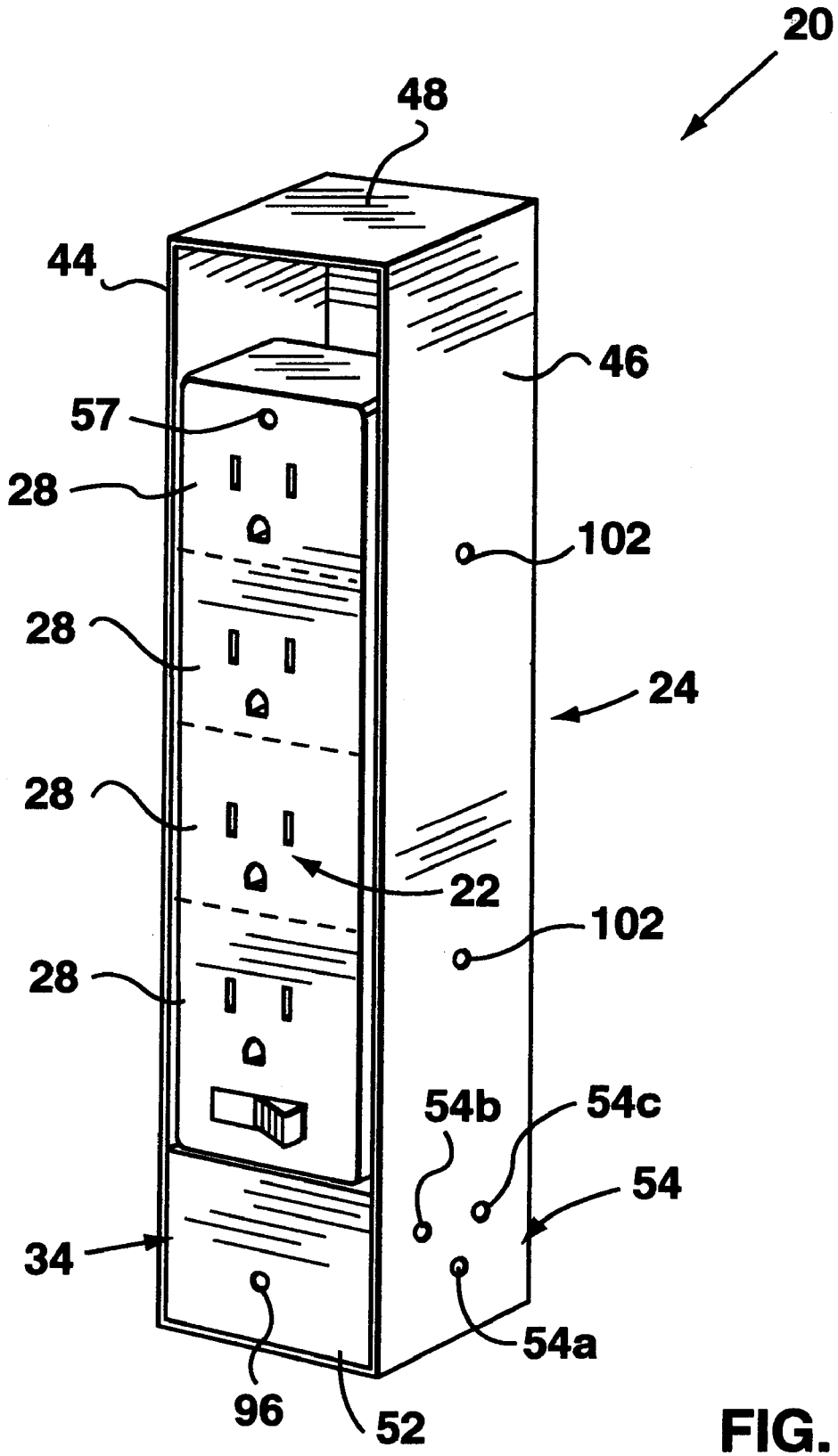
FIG. 1 is an isometric view of a wall-mountable electrical outlet assembly according to a first preferred embodiment of the invention, shown in an upright position.
Figure 2:
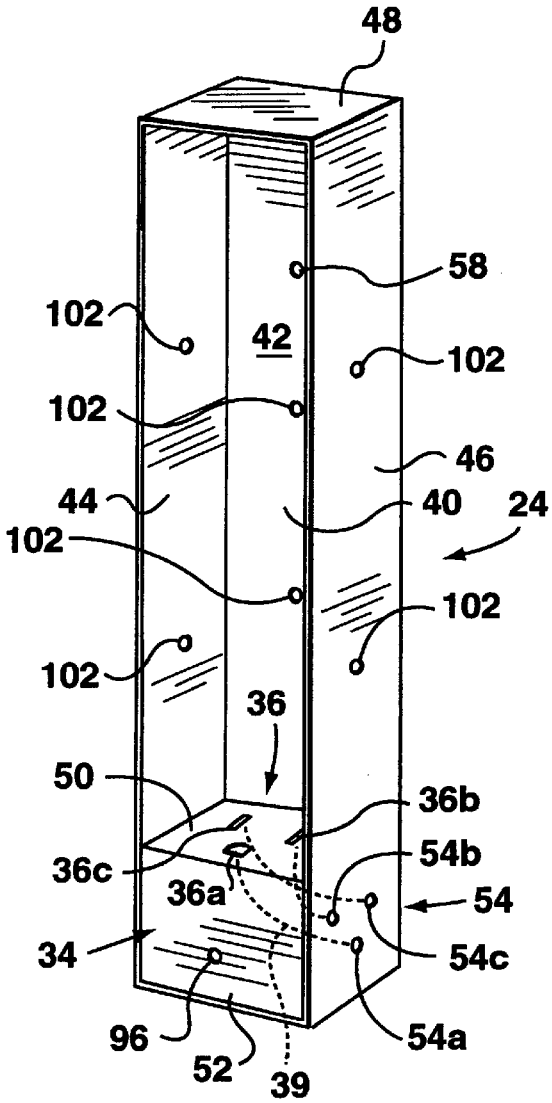
FIG. 2 is an isometric view of a housing of the outlet assembly shown on its own in an upright position.
Figure 3:
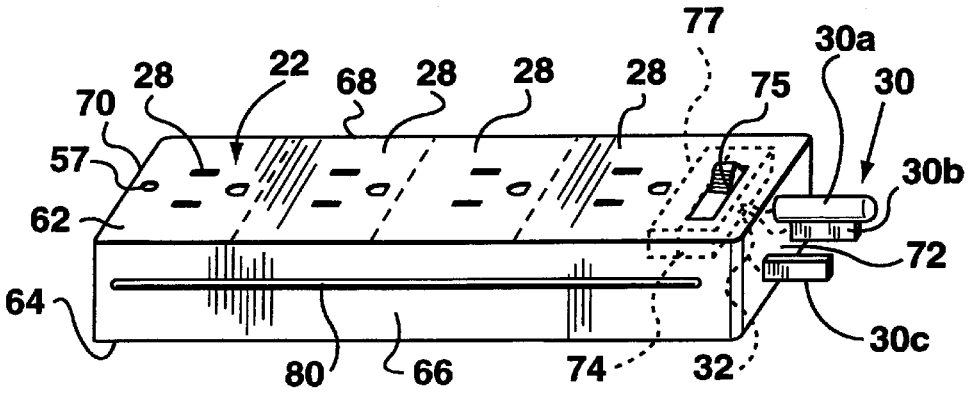
FIG. 3 is an isometric view of an electrical outlet of the outlet assembly shown on its own and placed horizontally.

Referring mainly to FIG. 1 but with reference also to FIGS. 2 and 3, an electrical outlet assembly designated generally by reference numeral 20 is shown. The outlet assembly 20 is installable in a cavity of a wall (not shown) of a building and is for use in connecting an electrical appliance (not shown) to a source of electrical power (also not shown). The outlet assembly 20 includes an electrical outlet 22 and a housing 24 for releasably receiving the electrical outlet 22, as will be described further below. The electrical outlet 22 has four outlet sockets 28 for receiving an electrical connector in the form of a plug (not shown) of the appliance. Referring to FIG. 3, the electrical outlet 22 also has an outlet connector in the form of plug 30, and means 32 (shown schematically in chain dotted outline in FIG. 3) for connecting the outlet sockets 28 to the plug 30. Referring to FIG. 2, the housing 24 has a power terminal 34 which includes a housing socket indicated generally by reference numeral 36 for releasably receiving the plug 30 of the electrical outlet 22. The power terminal 34 further includes means for connecting the housing socket 36 to the power source, as will be described further below. The housing 24 further has a front opening 40 sized to receive the electrical outlet 22 therethrough and for communicating with an exterior of the wall when the housing 24 is mounted inset in the wall. When the housing 24 is mounted inset in the wall and the housing socket 36 is connected to the power source, the electrical outlet 22 may be releasably received in the housing 24 (as shown in FIG. 1) by inserting the electrical outlet 22 through the opening 40 and inserting the plug 30 in the housing socket 36. An electrical appliance may be then connected to the power source by inserting an electrical plug of the appliance in a socket 28 of the electrical outlet 24.

As can be seen with reference to FIG. 2, the housing 24 is in the form of an open-fronted box having a back wall 42, a pair of opposed side walls 44,46 extending forwardly from the back wall 40, and a pair of opposed end walls 48, 50 extending between the side walls 44, 46 and forwardly of the back wall 42. The housing socket 36 is disposed in the bottom end wall 50 which forms a top wall of a closed terminal box 52 of the terminal 34. The housing socket 36 has a socket aperture 36*a* for receiving a ground pin 30*a* of the plug 30 of the electrical outlet 22, and socket apertures 36*b* and 36*c* for receiving line and neutral pins 30*b*, 30*c*, respectively, of the plug 30.

The means for connecting the housing socket 36 to a power source includes a connector 54 for connecting wires from an electrical power cable to the housing terminal 34. Connector 54 has connector gripper 54*a* for engaging an earth wire of the power cable, and connector grippers 54*b* and 54*c* for engaging line and neutral wires of the power cable, respectively. It will be understood that a wire from a power cable is connected to connector 54 by placing a bare end of the wire into a blind hole in which there is a gripper, e.g. 54*a*, for securing the bare end. The means for connecting the housing socket 36 to a power source further includes internal wires 39 (shown schematically in chain-dotted outline) for connecting the grippers 54*a*, 54*b* and 54*c* to socket apertures 36*a*, 36*b* and 36*c*, respectively.

Once received in the housing 24, the electrical outlet 22 may be secured to the housing 24 by inserting a securing screw (not shown) through an aperture 57 extending through an end portion of the outlet 22 remote from the plug 30 (see FIGS. 1 and 2), and through a threaded mounting hole 58 (shown in FIG. 3) formed in back wall 42 of the housing 24.

The electrical outlet 22 will now be described in more detail with reference to FIG. 3. The electrical outlet 22 has a front 62, a back 64 spaced from the front 62, a pair of opposed sides 66, 68 extending between the front 62 and the back 64, and a pair of ends 70, 72 extending between the front 62 and the back 64 and between the opposed sides 66, 68. The sockets 28 are disposed in the front 62 and are electrically connected to plug 30 by internal wires 32. The plug 30 consists of an earth pin 30*a*, and line and neutral pins 30*b* and 30*c*, which extend perpendicularly away from the end 72. Between sockets 28 and plug 30 is a means for limiting the maximum current flowing from the plug 30 to the sockets 28 in the form of a conventional resettable breaker switch 74 (shown schematically in chain-dotted outline). The breaker switch 74 has a rocker switch 75 associated therewith. When the breaker switch 74 is tripped, rocker switch 75 can be used to reset it. It can also be used as a manual on-off switch for switching power on or off between plug 30 and sockets 28. Also between sockets 28 and plug 30 is a conventional power spike and line noise protector 77 (also shown schematically) for filtering out power spikes and line noise reaching sockets 28. Pins 30*a–c* of plug 30 are insertable in corresponding apertures 36*a–c* of the housing socket 36.

Figure 4:
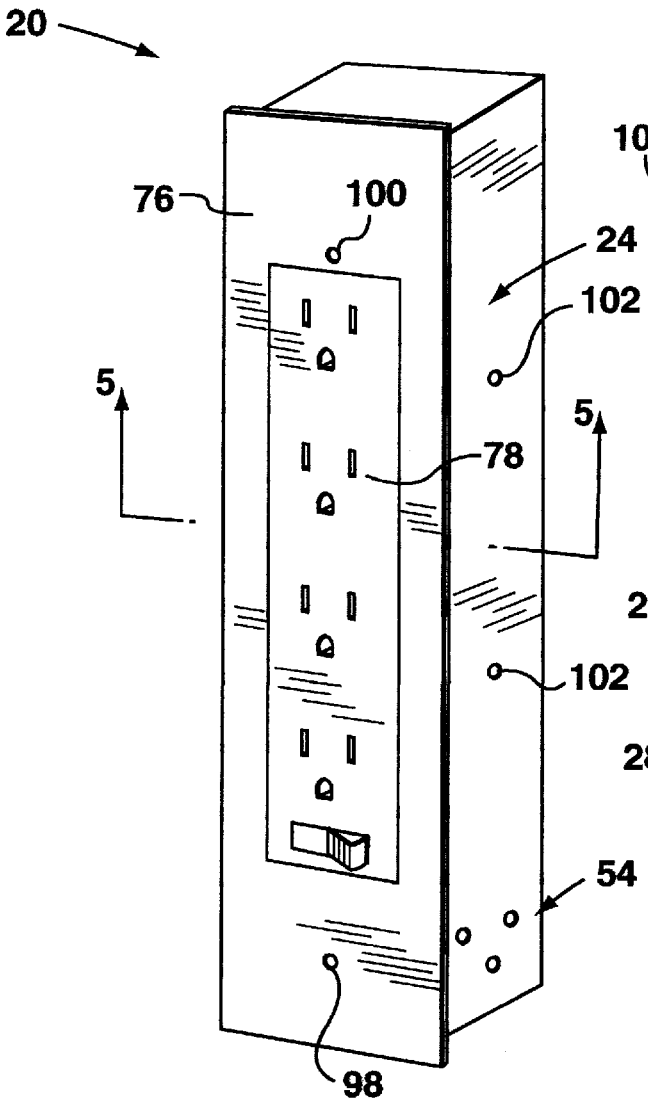
FIG. 4 is another isometric view of the electrical outlet assembly shown with an optional face plate removably attached thereto.
Figure 5:
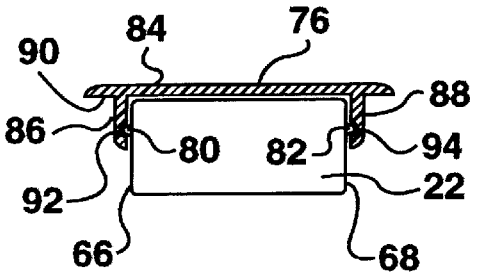
FIG. 5 is a sectional view taken generally along line 5—5 of FIG. 4 with the housing removed for simplicity.

Referring now to FIGS. 4 and 5, the assembly 20 includes an optional face plate 76 having a central opening 78. The face plate 76 is attachable to the electrical outlet 22 as can be seen in FIG. 5 as follows. The electrical outlet 22 has a pair of ridges 80, 82 formed one to each side 66, 68 thereof. The face plate 76 includes a front member 84 and a pair of lugs 86, 88 integrally formed with the front member 84 and extending perpendicularly from a rearward side 90 thereof. Each lug 86, 88 has a channel 92, 94 for receiving a respective ridge 80, 82 of the electrical outlet 22 in a snap fit. The face plate 76 can be snapped onto the electrical outlet 22 when it is received inside the housing 24 thereby covering an outer periphery of the opening 40 of the housing 24 and exposing the sockets 28 of the electrical outlet 22 through the central opening 78 of the face plate 76.

Once snapped on, the face plate 76 can be more permanently secured within the assembly 20 by inserting a pair of securing screws (not shown) through two sets of aligned apertures. A first set of aligned apertures consists of holes 96 and 98 formed in the front of terminal box 52 and the bottom of face plate 76, respectively (see FIGS. 1 and 4). A second set of aligned apertures consists of holes 58, 57, and 100, extending through the back wall 42 of the housing 24, a top portion of the electrical outlet 22, and a top portion of the face plate 76, respectively (see FIGS. 2, 1, and 4). The securing screw extending through holes 58, 57, and 100 also serves to secure the electrical outlet 22 to the housing 24.

The housing 24 also has small apertures 102 in sides 44, 46 and in back 42 for attaching the housing 24 to a wooden stud or the like, with screws or nails, as is known in the art.

In use, the housing 24 is installed inside a cavity in a wall so that the opening 40 of the housing 24 communicates with an exterior of the wall through an opening in the wall. The housing 24 is mounted such that it lies substantially flush with the outside of the wall. This is the most usual installation in newly constructed establishments. When retrofitting an older establishment, the housing 24 may be mounted externally to the wall, on a beam or the like, as is known in the art. Connector 54 is then connected to an electrical power cable so that electrical power can be supplied to the housing socket 36.

After installing the housing 24, the electrical outlet 22 is inserted into the housing 24 with the plug 30 of the outlet 22 inserted into the housing socket 36. The face plate 76 is then installed over the electrical outlet 22.

The housing 24, electrical outlet 22, and face-plate 76 may be sold separately or as a kit, with requisite additional accessories such as securing screws.

The assembly of the present invention is useful for providing a plurality of outlets which are protected from power spikes and line noise and which have a resettable breaker right at the outlet 22. Furthermore, if the circuitry for the power spike and line noise protector or breaker switch become defective, the electrical outlet 22 is easily replaced without having to damage the surrounding wall.

The above description of the preferred embodiment is by way of example only and shall not be used to limit the scope of the invention as defined by the claims herein. For example, The housing terminal 34 may be at the top of the housing 24. Also, the housing 24 could be used horizontally so that the housing terminal 34 would be at one side of the housing 24.

Figure 6:
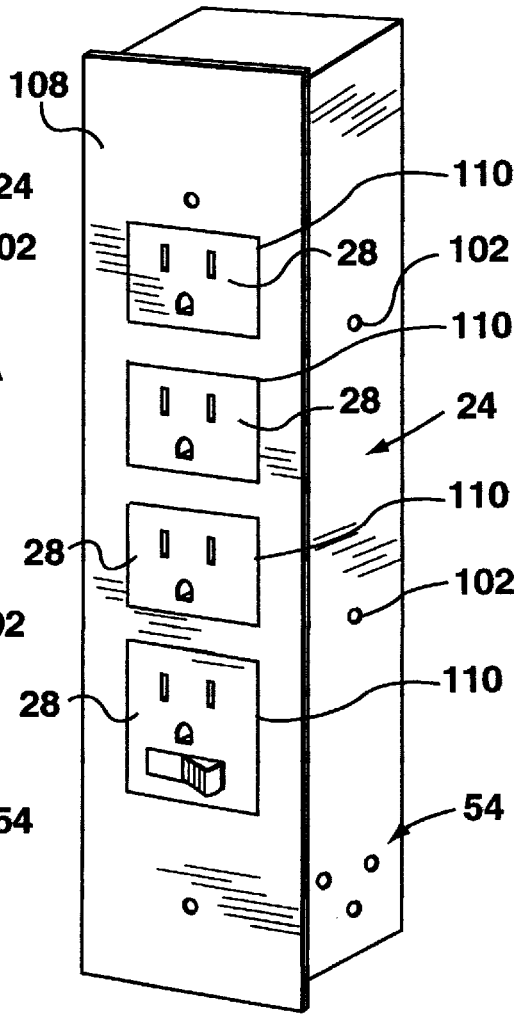
FIG. 6 is an isometric view of the electrical outlet assembly with an optional alternative face plate removably attached thereto.

As an alternative to face plate 76, a face plate 108 according to an alternative embodiment (shown in FIG. 6) may be used. The face plate 108 has individual apertures 110 in register with each of the sockets 28 thereby providing access to the sockets 28.

Figure 8:
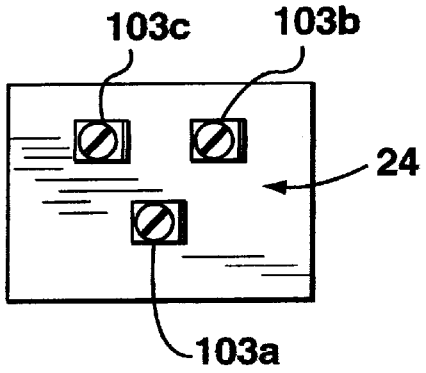
FIG. 8 is a bottom view of a housing according to a third preferred embodiment of the invention.

Although connector 54 is shown on the side of housing 24, it may be underneath (as shown in FIG. 8) or at the back of the housing 24. FIG. 8 also shows the connector to be screw type connectors 103*a–c* as distinguished from the grippers of the first preferred embodiment.

Figure 7:
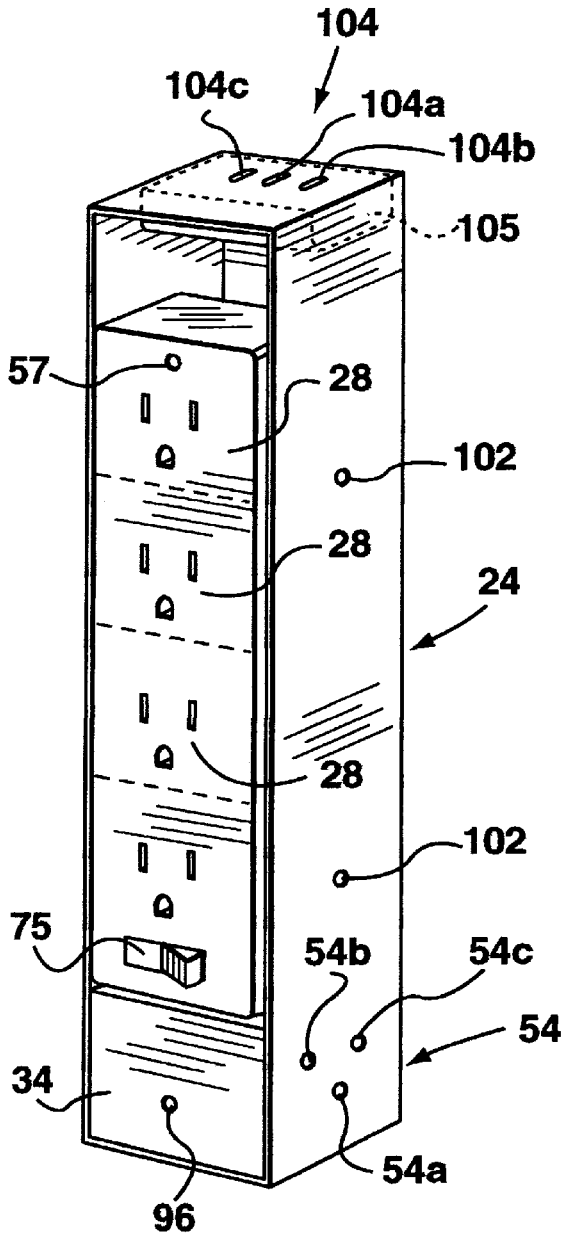
FIG. 7 is a view similar to the view of FIG. 1 of a housing according to a second preferred embodiment of the invention shown in an upright position.

Optionally, there may be electrical wires connecting connector 54 to a further terminal 105 at the top of the housing, as shown schematically in FIG. 7. In such case, current flowing to connector 54 will flow not only to housing socket 36 but also to the further terminal 105. By fitting an electrical power cable to grippers 104*a–c* of connector 104 of the further terminal 105, current reaching the further terminal 105 may then be taken to another electrical outlet connected to the power cable. It will be understood that the further terminal 105 may be disposed in any suitable position on the housing (e.g. adjacent to connector 54 the first preferred embodiment) instead of being at the top of the housing 24 as shown in FIG. 7.

The housing 24 and electrical outlet 22 may be made of conventional materials, e.g. metal and plastics, while the face plate 76 is preferably made of plastic material. Suitable plastics for the face plate 76 include ABS, high density polyethylene, polypropylene, and polystyrene.

The housing 24 may be mounted within a wall cavity in any manner known in the art.

Finally, the word "socket" used throughout the specification is herein defined to include any means for connecting an electrical connector of an appliance to an electrical outlet, or for connecting an electrical connector of an electrical outlet to a housing for the outlet, and shall not be construed to be limited to the particular structure shown in the drawings.

What is claimed is:

1. An electrical outlet assembly installable in a wall of a building for use in connecting an electrical appliance to a source of electrical power and comprising:

an electrical outlet having a front, a back spaced from the front, a pair of opposed sides extending between the front and the back, a pair of ends extending between the front and the back and between the opposed sides, at least one outlet socket disposed in said front for receiving an electrical connector of the appliance, an outlet connector comprising pins extending perpendicularly away from one of said ends, and means for electrically connecting the at least one outlet socket to the outlet connector;

a housing for releasably receiving said electrical outlet and comprising an open-fronted box having a back wall, a pair of opposed side walls extending forwardly from said back wall, and a pair of opposed end walls extending between said side walls and forwardly of said back wall, a power terminal, the power terminal having a housing socket disposed in one of said end walls for releasably receiving said outlet connector, means for electrically connecting the housing socket to a power source; and a face plate having a central opening and being releasably attachable to said electrical outlet to cover an outer periphery of the front of the housing and to expose said at least one socket of the electrical outlet through said central opening when the electrical outlet is received in said housing, said electrical outlet having a pair of ridges formed one to each side thereof, and said face plate including a front member and a pair of lugs extending perpendicularly from a rearward side of the front member, each lug having a channel for receiving a respective ridge of said electrical outlet in a snap fit.

2. An electrical outlet assembly according to claim 1 wherein the electrical outlet has means for limiting the maximum current from the outlet connector to the outlet socket.

3. An electrical outlet assembly according to claim 2 wherein the means for limiting the maximum current flow is a resettable breaker.

4. An electrical outlet assembly according to claim 1 wherein the electrical outlet has means for controlling power spikes and line noise.

* * * * *